United States Patent [19]

Gianelo

[11] Patent Number: 4,475,449

[45] Date of Patent: Oct. 9, 1984

[54] METHOD AND APPARATUS FOR COMPACTING CONTAINERS

[76] Inventor: Angelo Gianelo, 565 S. 500 West, Salt Lake City, Utah 84101

[21] Appl. No.: 489,713

[22] Filed: Apr. 29, 1983

[51] Int. Cl.[3] ..... B30B 9/32

[52] U.S. Cl. ..... 100/42; 100/232; 100/266; 100/902

[58] Field of Search ..... 100/902, 266, 232, 35, 100/293, 42, 245

[56] References Cited

U.S. PATENT DOCUMENTS

| | | | |
|---|---|---|---|
| 3,106,888 | 10/1963 | Chapleau | 100/902 X |
| 3,732,804 | 5/1973 | Moller | 100/902 X |
| 3,766,849 | 10/1973 | Maron | 100/902 X |
| 3,780,647 | 12/1973 | Reimers | 100/902 X |
| 3,901,141 | 8/1975 | Bochmann | 100/902 X |
| 4,188,875 | 2/1980 | Fabbri | 100/902 X |
| 4,212,242 | 7/1980 | Willis | 100/902 X |
| 4,248,144 | 2/1981 | Morgan | 100/902 X |
| 4,292,891 | 10/1981 | Shelley | 100/902 X |
| 4,345,518 | 8/1982 | Cash | 100/902 X |

*Primary Examiner*—Billy J. Wilhite

*Attorney, Agent, or Firm*—Trask & Britt

[57] ABSTRACT

A method for compacting an empty container which comprises applying a compressive force to the sidewall of the container at two points substantially opposite to each other and approximately midway between the container ends thereby causing the sidewall of the container to collapse inwardly on a plane substantially perpendicular to the longitudinal axis of the container and approximately midway between the container ends. Upon release of the compressive force to the container sidewall, a second compressive force is applied to one end of the container while the other end is held firm, thereby causing the container sidewall to collapse along the longitudinal axis of the container so as to bring the container ends together. An empty container compacting device is also disclosed.

6 Claims, 5 Drawing Figures

METHOD AND APPARATUS FOR COMPACTING CONTAINERS

BACKGROUND OF THE INVENTION

1. Field:

The present invention relates generally to the disposal of used containers. More particularly, the present invention relates to the crushing of used containers prior to the disposal thereof. Still more particularly, the present invention relates to a method for collapsing and totally compacting metal containers and a device for practicing the method.

2. The disposal of a used container, by whatever means, has always been accompanied by the problem, or at least the considerable inconvenience, that an empty container occupies a considerable volume in relation to its weight. To minimize this problem or inconvenience, an empty container consigned to disposal is often first crushed or compacted in order to reduce its volume, a procedure that requires, at least for metallic containers, a force greater than that which can normally be easily and effectively applied by hand. As recycling of metal containers has come more into fashion, moreover, the significance of this problem has increased since recycle receiving stations often do not have the space to accept metal containers except in a compacted form. Accordingly, a number of hand operated metal container crushing or compacting devices have been proposed, the simplicity and effectiveness of which vary widely.

Existing hand operated metal container or can compacting devices are broadly based on one of two methods of compacting. One such method involves applying a compressive force to one or both ends of a container in order to collapse the container sidewall along the longitudinal axis of the container, thereby forcing the two container ends into flattened contact with each other. A device based on this method of compacting is shown in U.S. Pat. No. 4,188,875. A drawback to this method is that it requires a greater force to overcome the initial lateral resistance of the can sidewall than is subsequently required to compress the sidewall along the longitudinal axis of the container, a situation that could lead to hand or other injury to the operator if this is not taken into account in operation of the device. This drawback is recognized in U.S. Pat. No. 4,248,144 in which a rather complicated arrangement is suggested to eliminate its hazards.

The other method of container compacting involves the application of a compressive force to the sidewall of the container along substantially its entire length in order to collapse the sidewall inwardly upon itself so as to totally flatten the container. A device based on this method of container compacting is disclosed in U.S. Pat. No. 3,901,141. A drawback to this method, however, is that both the resistance of the container ends, as well as that of the container sidewall, must be overcome in order for the sidewall to collapse inwardly upon itself. It has been proposed to lessen the resistance of the container ends by first removing the ends as by cutting, a procedure that necessarily calls for more complicated device than might be desired. It has also been proposed to first buckle one or both ends of the container inwardly towards each other by applying a compressive force to the container ends at an angle to the longitudinal axis of the container. A compressive force is then applied along the length of the container collapsing the container ends together with the container sidewall inwardly. Various devices incorporating this proposal are illustrated in U.S. Pat. No. 3,766,849; 4,212,242; 4,248,144 and 4,292,891, all of which devices are, for the most part, more complicated than one would desire.

SUMMARY OF THE INVENTION

Although the two compacting methods above discussed, together with the various hand operated compacting devices based thereon, as disclosed in the various patents referred to, function with varying degrees of ease and effectiveness in compacting containers, they all are, nevertheless, subject to one or more of the mentioned disadvantages or drawbacks. Accordingly, there remains a need for a container compacting method not subject to these drawbacks. It is a principal object of this invention to fulfill this need. It is a further object of this invention to provide an improved method of compacting an empty metal container. It is a still further object of this invention to provide an improved container compacting device that employs the principles of the method of this invention. Another object of this invention is to provide an improved hand operated device for compacting or crushing containers, particularly small metal cans. Another object of this invention is to provide a method and apparatus for compacting empty containers that is effective in substantially reducing the volume of the container, is easily operated by hand and is totally safe in operation.

These various objects have been met by a method that comprises, as a first step, the application of a compressive force to an ever increasing portion of the sidewall circumference of an empty container. This force application is initiated at two points substantially opposite each other and midway between the container ends. As a result, the container sidewall is caused to collapse inwardly along a lateral axis substantially perpendicular to the longitudinal axis of the container. Once the container sidewall has thus collapsed and the compressive force released, the method comprises, as a second step, the application of a compressive force to one end of the container while the other end if firmly held against movement. As a result, the container sidewall is cause to collapse along the longitudinal axis of the container thereby forcing the two container end walls into substantial contact with each other and reducing the volume of the container to a fraction of its non-compacted volume.

The several objects of this invention have been further met by a device for compacting an empty container that generally comprises a non-rotatable container support platform for supporting an empty container on one of its ends. Positioned for movement within the device for movement toward the supported container and along an axis corresponding to the longitudinal axis of the container, is a non-rotatable compression plate designed for contacting the container end wall and collapsing the container sidewall along the container axis. Associated with the compression plate are two compression frames designed for contacting an ever increasing portion of the container sidewall and collapsing the sidewall inwardly along an axis substantially perpendicular to the axis of the container and on a plane substantially midway between the container ends. In operation of the device, movement of the compression plate toward the supported container causes the compression frames to contact and collapse the container sidewall along a lateral or horizontal axis, after which the continued movement of the compression plate brings it into contact with the container end causing collapse of the container sidewall along the container axis to thereby produce a totally end to end compacted container.

BRIEF DESCRIPTION OF THE DRAWINGS

In the drawings, which illustrate that which is presently regarded as the best mode of carrying out the invention.

DESCRIPTION OF THE PREFERRED EMBODIMENT

Figure 1:
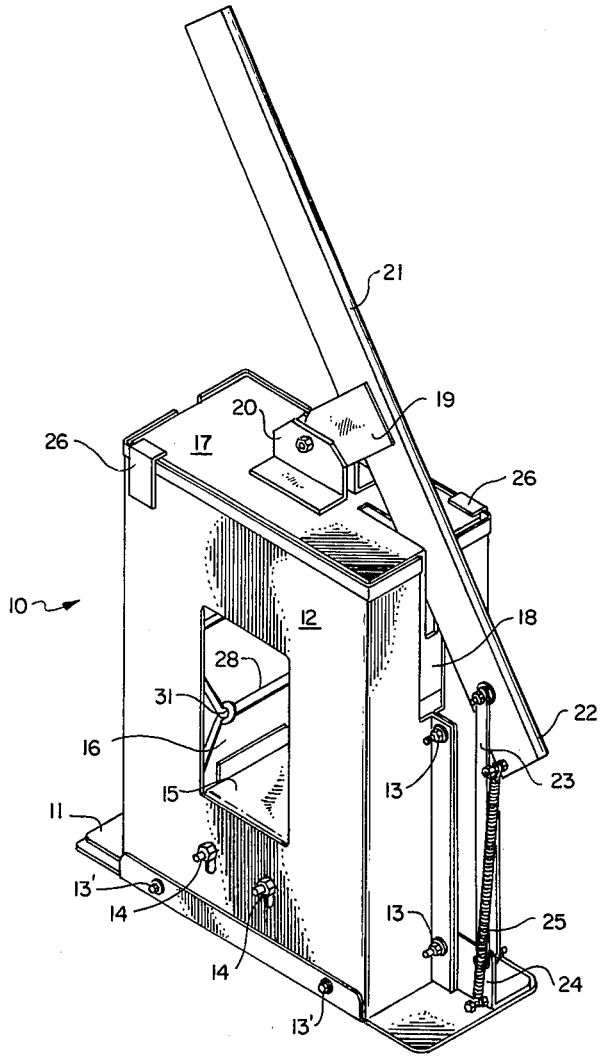
FIG. 1 is a perspective view of a compacting device according to this invention.
Figure 2:
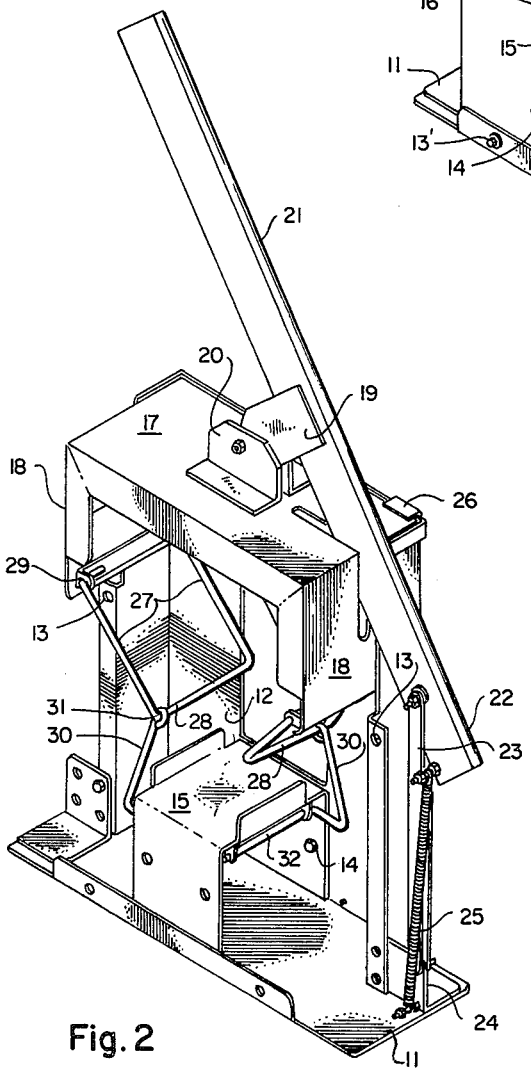
FIG. 2 is a perspective view similar to that of FIG. 1 but partially in section.

Turning now to FIGS. 1 and 2 of the drawing, there is shown therein a compacting device in accordance with this invention represented generally by reference numeral 10. Compacting device 10 comprises a horizontal base member 11 and vertical side and end enclosing panels 12 joined to each other by means 13 and to horizontal base member 11 by means 13. Secured to side enclosing panels 12 by means 14 is a non-rotatable support platform 15 on which an empty container can be placed on one of its ends by being inserted through an opening 16 fashioned in one of the side enclosing panels 12. Compacting device 10 is further provided with a non-rotatable longitudinal compression plate 17 having associated therewith two compression plate arms 18 designed for movement in tracks located in end panels 12 which provides motion to compression plate 17 along an axis corresponding to the axis of the container. Pivoted to the top of compression plate 17 by means of a first pivot arm 19 and bracket 20 is an operating lever 21, which is connected at one of its ends 22 by means of a second pivot arm 23 to a flange 24 secured to horizontal base member 11 adjacent to one of the end enclosing panels 12. Also secured by one of its ends to flange 24 and by its other end to operating lever end 22 is a tension spring 25. Secured to the top of each side panel 12 is a stop 26 designed to halt the upward movement of compression plate arms 18 and compression plate 17.

Referring specifically to FIG. 2, there is shown two lateral compression frames each one of which is adjacent to an end enclosing panel 12. Each compression frame comprises two upper arms 27 jointed to a lateral compression bar 28 to form a unitary U-shaped structure, the unjoined ends of upper arms 27 of which are pivotally mounted by means 29 to the lower end of the compression plate arm 18 to which it is adjacent. Each compression frame also comprises a single lower arm 30 to the upper end of which is pivotally mounted compression bar 28, as shown by reference numeral 31, and the lower end of which is pivotally connected to container support platform 15 at a side thereof facing the corresponding end panel 12, a shown by reference numeral 32. As shown in FIG. 2, each compression frame bar 28 is pivotally connected to its respective lower arm 30 at an end thereof opposite to the end at which the other compression bar 28 is connected to its respective lower arm 30. The same opposing relationship prevails with respect to the pivoting of the lower ends of lower arms 30 to support platform 15. Lower arms 30 are of shorter length than upper arms 27, a length differential that will be considered in more detail hereinafter.

Figure 3:
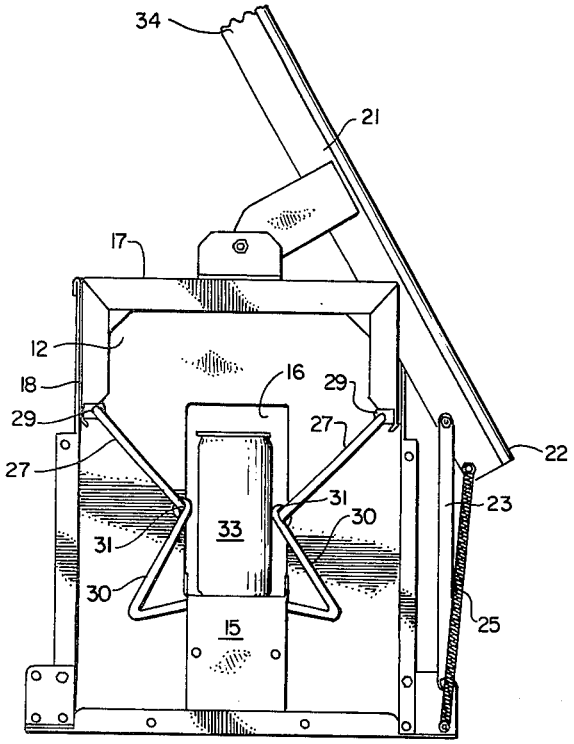
FIG. 3 is an end view of the compacting device showing the progression of the compression plate in its movement to a point where the compression frames make contact with the sidewall of the container to be compacted.
Figure 4:
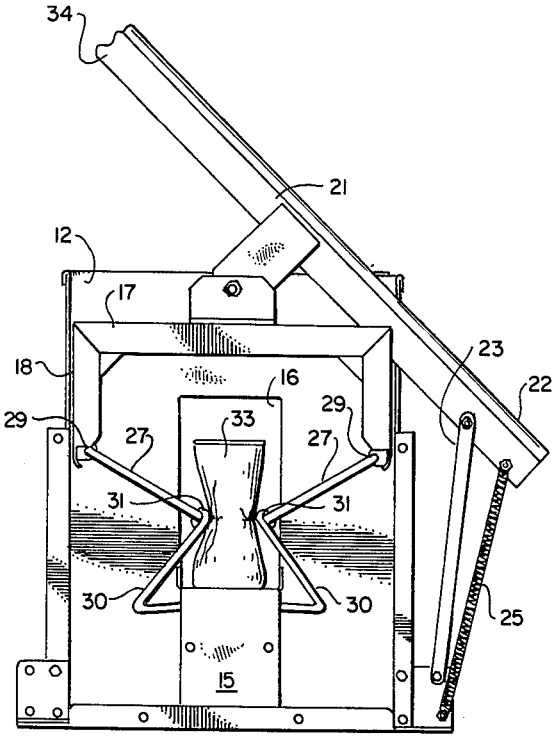
FIG. 4 is an end view similar to that of FIG. 3 showing progression of the compression plate to a point where the compression frames have begun the collapse of the container sidewall inwardly along an axis substantially perpendicular to the longitudinal axis of the container.
Figure 5:
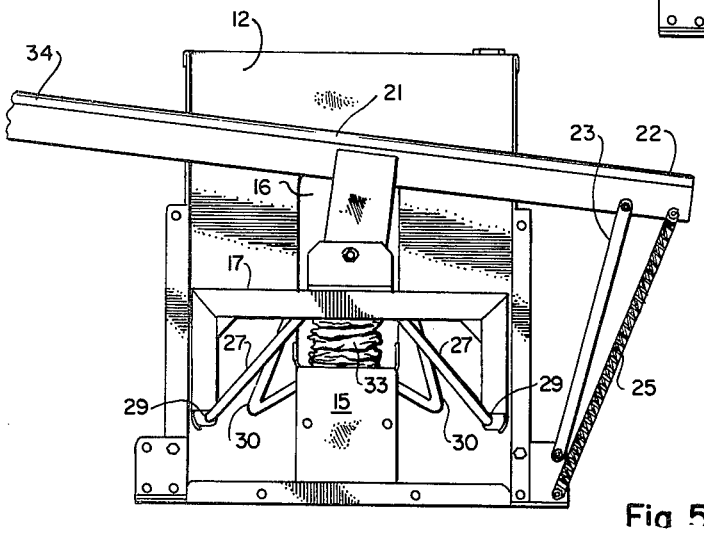
FIG. 5 is an end view similar to those of FIGS. 3 and 4 showing further progression of the compression plate to a point where the compressive force of the compression frames has been released, the compression has contacted the container end wall, and collapse of the container sidewall along the container axis has begun.

Progressive movement of compression plate 17 along its axis corresponding to the longitudinal axis of an empty container 33 placed on end on support platform 15 results in collapsing of the container sidewall, first along an axis perpendicular to the longitudinal axis of the container on a plane substantially midway between the container ends, and second, along the longitudinal axis of the container. As shown in FIG. 3, as compression plate 17 moves downwardly in response to pressure applied to end 34 of pivoted operating lever 21, upper arms 27 of the compression frames begin to pivot at points 29 and 31 while lower arms 30 pivot at points 32 thereby causing compression bars 28 to move, by virtue of the greater length of upper arms 27 as compared to lower arms 30, laterally inwardly until they contact the sidewall of container 33 at two points substantially opposite to each other and approximately midway between the ends of container 33. Lateral movement of compression bars 28 continues as compression plate 17 progresses in its downward direction initiating the collapse of the sidewall of container 33 inwardly on a plane substantially perpendicular to the longitudinal axis of container 33 and approximately midway between the ends thereof, as shown in FIG. 4. Continued pressure applied to lever 21 causes compression plate 17 to continue its downward travel until it reaches a level at which the inward collapsing of the sidewall of container 33 is complete. At this point, the difference in length between upper arms 27 and lower arms 30 causes compression bars 28 to reverse their direction of movement, thereby relieving the compressive force earlier exerted by them on the sidewall of container 33. At approximately the same time as compression bars 28 move away from the sidewall of container 33, compression plate 17 makes its initial contact with the top end of container 33. As compression plate 17 moves downwardly thereby applying compressive force to the top end of container 33, the sidewall of the container is caused to collapse along its longitudinal axis, a process that is facilitated by the fact that the lateral resistance initially offered by the container sidewall has been minimized, if not totally eliminated, by the earlier inward collapsing of the sidewall by the laterally moving compression bars 28. As shown in FIG. 5, the sidewall of container 33 is approaching total collapse so that the container end walls are brought into substantial contact with each other. At this point, the compacting precedure is complete. Operating lever 21 is returned to its original position by spring 25 when pressure is released, the compacted container removed from compacting device 10, and the procedure repeated with another container.

The present invention provides a method that is simple and effective in practice. It can be practiced on containers of varying sizes and requires only that a compacting device be appropriately sized to accommodate the size of container. The method is particularly designed, however, as is the embodiment of the device illustrated in the drawings, for compacting small metallic cans such as are used as containers for beverages with respect to which the method and device have been found particularly useful. By compacting a metal container of this type through the application of successive compressive forces along axes substantially perpendicular to each other, the drawbacks of other methods and apparatuses that rely on the use of single compressive force applied along a single axis are minimized or eliminated. The method and device of this invention can be safely practiced by anyone without risk of injury through the application of a single smooth hand motion that reduces a metal container to a fraction of its uncompacted volume in an instant.

Reference in the disclosure to details of the specific embodiments described is not intended to restrict the scope of the appended claims, which themselves recite those features regarded as essential to the invention.

I claim:

1. A method of compacting an empty container which comprises:

applying a compressive force through bar-like means to the sidewall of said container, said force application being initiated at two points substantially opposite to each other and between the ends of said container progressing therefrom to contact an increasing portion of the container's perimeter thereby causing said container sidewall to collapse inwardly along an axis substantially perpendicular to the longitudinal axis of said container;

releasing said compressive force and approximately simultaneously applying a compressive force to one end of said container while the other end is firmly supported so as to collapse the sidewall of said container along the longitudinal axis of said container thereby causing said container ends to be brought together.

2. An empty container compacting device comprising:

means for non-rotatably supporting an empty container on one of its ends;

means for providing a compressive force against the sidewall of said container, said force being initiated at two points substantially opposite to each other and between the ends of the container and progressing to contact an every increasing portion of the container's perimeter so as to collapse said container sidewall inwardly along an axis substantially perpendicular to the longitudinal axis of the container;

means for releasing the compressive force applied to said container sidewall; and means for applying a compressive force to the unsupported end of said container so as to collapse the sidewall thereof along the longitudinal axis of said container.

3. A hand operated empty container compacting device comprising:

a container support platform for supporting an empty container on one of its ends;

a compression plate adapted to move along an axis corresponding to the longitudinal axis of said container and to contact the unsupported end of said container;

two compression frames associated and adapted to move with said compression plate and to contact the sidewall of said container at two locations substantially opposite to each other and between the ends of said container, said compression frames also being adapted to contact the sidewall of said container before said compression plate contacts the end of said container, each of said compression frames comprising two upper arms and a compression bar which together form a U-shaped structure and a lower arm; and means for moving said compression plate toward said container end whereby said compression frames contact said container sidewall and collapse the same inwardly along an axis substantially perpendicular to the longitudinal axis of said container, and whereby said compression plate contacts the end of said container after release of the compressive force to said container sidewall and collapses said sidewall along the longitudinal axis of said container.

4. An empty container compacting device according to claim 3 in which the two upper arms are pivotally connected to compression plate arms associated with said compression plate, the compression bar is pivotally connected to one end of the lower arm, and the other end of the lower arm is pivotally connected to said container support platform.

5. An empty container compacting device according to claim 4 in which the means for moving said compression plate comprises a hand operated lever.

6. A hand operated empty container compacting device comprising:

a non-rotative container support platform for supporting an empty container on one of its ends;

a non-rotative compression plate adapted to move along an axis corresponding to the longitudinal axis of said container and to contact the unsupported end of said container;

two compression frames associated and adapted to move with said compression plate and to apply a compressive force to the sidewall of said container, said force application being initiated at two locations substantially opposite to each other, and between the ends of said container and progressing therefrom to contact an increasing portion of the container's perimeter thereby causing said container sidewall to collapse inwardly along an axis substantially perpendicular to the longitudinal axis of said container, said compression frames also being adapted to contact the sidewall of said container, collapse said sidewall and thereafter release said compressive force application before said compression plate contacts the end of said container; each of said compression frames comprising:

two upper arms, each of said upper arms being pivotally connected to compression plate arms associated with said compression plate, a compression bar which interconnects said upper arms, thereby forming a "U"-shaped structure, said compression bar being pivotally connected to one end of a lower arm, said lower arm having a dimensional length shorter than either of said upper arms, one end of said lower arm being pivotally connected to said container support platform, wherein a hand operated means for moving said compression plate toward said container end is provided whereby said compression frames contact said container sidewall and collapse the same inwardly along an axis substantially perpendicular to the longitudinal axis of said container, and whereby said compression plate contacts the end of said container after release of the compressive force to said container sidewall and collapses said sidewall along the longitudinal axis of said container.

* * * * *